United States Patent [19]

Wurr et al.

[11] 4,193,759

[45] Mar. 18, 1980

[54] ROTARY KILN WITH A PLURALITY OF PLANETARY COOLING TUBES

[75] Inventors: Jürgen Wurr, Ennigerloh; Antonius Vering, Ahlen; Bodo Ermer, Sendenhorst, all of Fed. Rep. of Germany

[73] Assignee: Polysius AG, Neubeckum, Fed. Rep. of Germany

[21] Appl. No.: 866,559

[22] Filed: Jan. 3, 1978

[30] Foreign Application Priority Data

Jan. 25, 1977 [DE] Fed. Rep. of Germany ..... 2702876

[51] Int. Cl.[2] ..... F27B 7/38

[52] U.S. Cl. ..... 432/78; 285/183; 432/80

[58] Field of Search ..... 432/77, 80, 82, 78, 432/251; 285/183

[56] References Cited

U.S. PATENT DOCUMENTS

| | | | |
|---|---|---|---|
| 3,682,457 | 8/1972 | Hollingsworth | 432/251 |
| 3,790,335 | 2/1974 | Andreassen | 432/80 |
| 3,792,961 | 2/1974 | Theil | 432/80 |
| 3,844,709 | 10/1974 | Ghestem | 432/80 |
| 3,927,960 | 12/1975 | Endersen | 432/80 |

*Primary Examiner*—Henry C. Yuen

*Attorney, Agent, or Firm*—Learman & McCulloch

[57] ABSTRACT

A rotary kiln has at one end circumferentially spaced apart outlet openings into each of which extends a sleeve establishing communication between the interior of the kiln and a planetary cooling tube. Encircling the inner end of each sleeve is a refractory collar that is flush with the surface of the kiln's lining. Between each tube and the edge of the associated outlet is a thermally insulative packing.

15 Claims, 4 Drawing Figures

ROTARY KILN WITH A PLURALITY OF PLANETARY COOLING TUBES

The invention relates to a rotary kiln with a plurality of planetary cooling tubes, the intake branches of which are connected with the interior of the kiln by means of sleeve-like intake rings that are positioned in the kiln discharge ports within the kiln shell and its lining.

The discharge port openings which are located in the circumferential wall of a rotary kiln and are connected with the intake branches of the planetary cooling tubes are subjected to particularly high thermal stresses, as well as considerable wear and tear. A refractory lining that is no longer intact but in the proximity of these discharge ports can lead to overheating of the kiln shell and consequently to serious damage.

In the rotary kilns that have hitherto been used sleeve-like intake rings of metal were provided adjacent to the discharge ports for the individual planetary cooling tubes in order to reduce damage to the refractory lining in the proximity of the kiln discharge ports. These intake rings projected at least partially into the kiln discharge ports provided in the peripheral kiln wall (kiln shell and lining). Sometimes these intake rings themselves have a refractory lining on their inside. One disadvantage that is generally associated with these known types of construction, however, is that an alignment gap is left between the kiln port openings proper and the external periphery of the intake rings in order to facilitate insertion. During kiln operation, however, the edge of the refractory kiln lining in the interior of the kiln is often shattered by coarse calcined material or even crushed by dust which accumulates in the annular gap between the intake ring and the refractory lining. The result of this is that the refractory lining in the proximity of the furnace discharge ports cannot any longer provide satisfactory protection for the kiln shell and consequently repair work has to be conducted on this refractory lining in many cases after only a short working time for the rotary kiln.

The object of the invention is therefore to provide optimum protection for the critical regions of the kiln discharge port linings leading to the individual planetary cooling tubes.

This object is achieved according to the invention by furnishing at least that section of the intake ring which projects into the kiln shell lining with a circumferential collar of the lining material on its exterior and inserting this into a corresponding annular recess in the kiln shell lining.

Because the intake ring according to this embodiment of the invention features a peripheral collar of refractory lining material, at least to the extent to which it projects into the kiln shell lining, no annular gap is formed between the kiln shell lining and the intake ring and there is no shoulder in the section of the kiln discharge port located in the kiln shell lining, as is the case in previous constructions, and accordingly a breaking away or flushing out of these kiln port sections is avoided. The peripheral collar of refractory lining material with which each intake ring is provided according to the invention on the contrary constitutes a relatively compact block in the neighborhood of the endangered edge zones which protects these regions of the kiln discharge ports against excessive thermal stresses as well as against increased wear and tear.

In accordance with a preferred embodiment of the invention, the annular, circumferential collar is divided into a plurality of annular segments by the insertion of thin strips of material in a peripheral direction. These strips of material, which can consist of cardboard or like material, for example, enable the differing degrees of thermal expansion occurring between the metal intake ring and the refractory lining material to be taken up by the circumferential collar.

Moreover, it is expedient to provide a thin interface between the external periphery of the collar adjacent to the kiln shell lining and the opposite interior circumferential region of the recess in the kiln shell lining. In this way the peripheral collar of lining material is joined to the kiln shell lining in a substantially direct manner, without however being directly connected to it.

If a kiln outlet connection is supplied for each kiln discharge port at the exterior of the kiln shell and this connection surrounds the longitudinal section of the intake ring protruding from the kiln shell to form an annular gap, then it is also advantageous according to the invention for the longitudinal section of the intake ring that is surrounded by the annular gap to feature no lining material, and to loosely insert material that is temperature stable and thermally insulating. This enables the temperature of the kiln outlet connection to be kept relatively low and, moreover, prevents dust from infiltrating into the annular gap, as well as serving to completely seal off the annular gap from the kiln interior by means of the peripheral collar.

The invention is explained in more detail on the basis of a number of practical examples illustrated in the drawings wherein.

Figure 1:
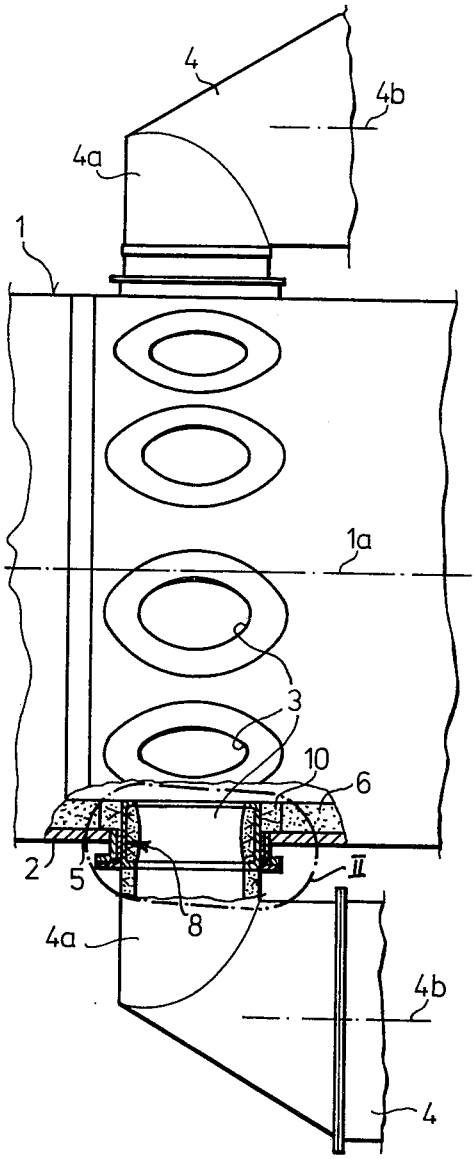
FIG. 1 is a fragmentary elevational view, partly in section, of the discharge end of the rotary kiln according to the invention.

For the sake of simplicity, only that portion of the discharge end of a rotary kiln 1 according to the invention is depicted. In the peripheral wall 2 kiln discharge ports 3 are located which are uniformly spaced from each other around the periphery of the rotary kiln 1. Fitted into each port is an intake branch **4*a* (only two of which are shown). The radially outer end of each intake branch is connected to a planetary cooling tube 4 which is capable of alignment along axis 4*b* parallel to the axis 1*a*** of the rotary kiln in the customary manner.

The peripheral wall 2 of the rotary kiln 1 largely comprises the metallic kiln shell 5 and the refractory lining 6 of the kiln shell. For each kiln discharge port 3 at the exterior of the kiln shell 5, a kiln outlet connection 7 is attached to the exterior of the kiln shell, and to which the intake branch **4*a* of the associated planetary cooling pipe 4** is connected.

Each intake branch **4*a* of a planetary cooling tube 4 is associated with a sleeve-like intake ring 8 of metal which protrudes into the respective kiln outlet port 3, thereby providing an annular gap 9 between the external circumference of the longitudinal section of the intake ring 8 passing through the kiln outlet connection 7 and the kiln outlet connection 7** itself.

Figure 2:
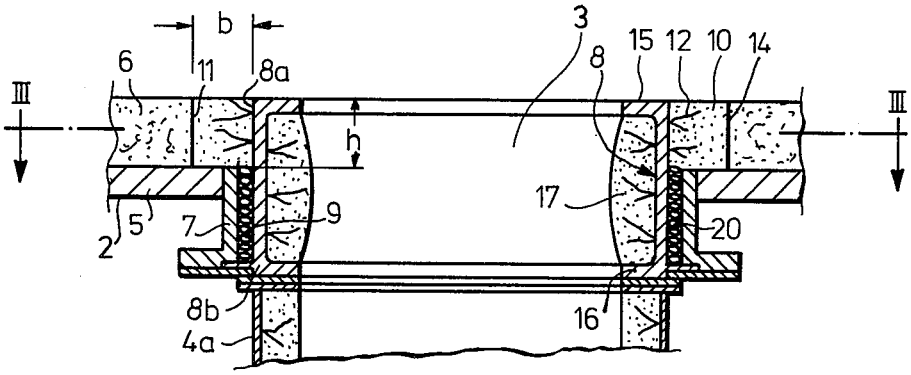
FIG. 2 is an enlarged detail sectional view (detail II) with the kiln discharge port and the inserted intake ring.

An important feature of the type of construction according to the invention is that, and as is particularly clearly shown in FIG. 2, at least that part 8*a* of each intake ring 8 protruding into the kiln shell lining 6 has an annular collar 10 of refractory lining material on its external periphery. For this reason, an annular recess 11 corresponding to the size of the collar is moulded into and around each kiln outlet connection 3, through which a kind of gradation is produced in the peripheral wall 2 of the kiln. The peripheral collar 10 of the intake ring 8 fits exactly into this annular recess 11 in the kiln shell lining 6, i.e., the width b of the collar 10 is substantially the same as the width (the radial dimension) of the recess 11, while the height h of the collar 10 corresponds to the height of the recess 11 and, consequently in this case, to the thickness of the kiln shell lining 6. In the case of the embodiment depicted in FIG. 2, the frontal surface of the peripheral collar 10 is flush with the end face of the intake ring 8 surface and with the internal circumferential surface of the kiln shell lining 6, so that no troublesome ledges are formed.

Figure 3:
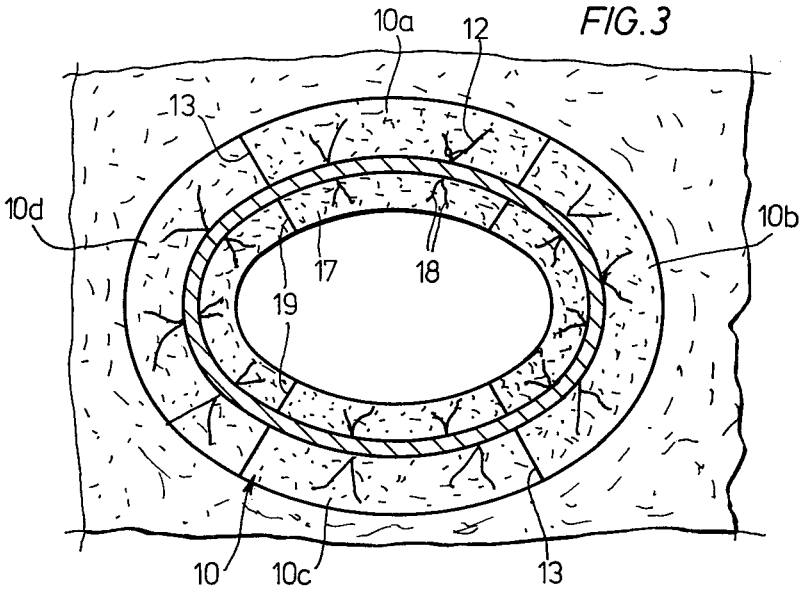
FIG. 3 is a sectional view taken on the line III—III of FIG. 2.

Hold-down members 12 for the lining material are attached to the lining material and to the circumferential area of the intake ring 8 associated with the collar 10. These hold-down members serve to retain the lining material and exhibit an undulating or roughened contour and are preferably provided in different lengths, as shown in FIG. 3 in particular.

In order to compensate for different degrees of thermal expansion between the metallic intake ring 8 and the refractory lining material of the collar 10, the collar 10 is divided into four ring segments 10*a*–10*d* (FIG. 3) in a peripheral direction by the insertion of thin strips of material, preferably cardboard strips 13. So that the collar 10, which consists of a refractory material, does not compound itself firmly to the remaining refractory lining material of the kiln shell lining 6, a thin separating layer is provided between the external periphery of the collar 10 adjacent to the kiln shell lining 6 and the opposite internal circumferential area of the recess 11, such as can be formed by a coating of lubricant applied to the external periphery of the collar 10, or by a circumferential strip of material having a slippery surface, for example oil paper.

As is shown in FIG. 2, each intake ring 8 is provided with a projecting flange 15, 16 at its opposite ends. The surface of the inner flange 15 is flush with the frontal area of the collar 10. A layer 17 of refractory lining material is provided between these two end flanges 15, 16, as well as on the internal circumferential surface of the intake ring 8. This layer 17, which likewise exhibits an annular form, extends in an axial direction with respect to the intake ring 8 from the inner side of the terminal flange 15 to the inner side of the terminal flange 16 and in its radial direction it has a thickness that corresponds approximately to the width of the end flanges 15, 16. However, in a preferred embodiment of the invention, the exposed surface of the layer 17 is arcuate (see FIG. 2) and the axial length of the layer corresponds exactly to the spacing between the terminal flanges 15, 16. In the intervening zone between the flanges the layer 17 bulges into the passage opening. The layer 17, just as the collar 10, is retained at the internal periphery of the intake ring 8 with the aid of hold-down members 18. Furthermore, this internal layer 17 of lining material can be divided into segments by the insertion of thin strips of material 19 like the members 13 to form segments in the peripheral direction and allow for different thermal expansion between the intake ring and the lining material.

The longitudinal portion 8*b* of the intake ring that is surrounded by the annular gap 9 does not feature any lining material. The annular gap 9 between the longitudinal section of the intake ring 8*b* and the kiln outlet connection 7 is, on the contrary, packed full with a temperature-resisting and heat-insulating material. This material can, for example, take the form of a termperature-resistant and heat-insulating ceramic band 20 which is inserted or pushed firmly into the annular gap 9 in several windings.

Figure 4:
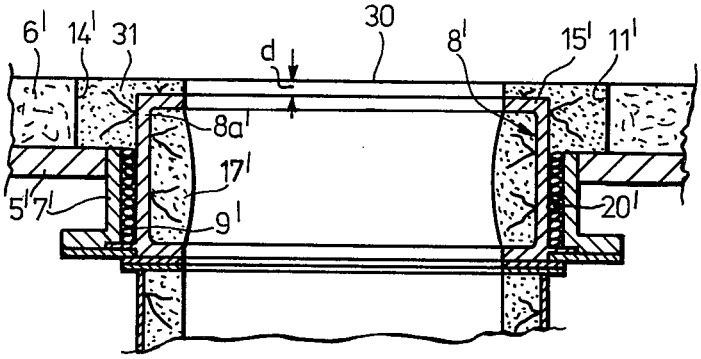
FIG. 4 is a sectional view similar to FIG. 2, but of another embodiment of the invention.

The embodiment illustrated in FIG. 4 is a modification of the embodiments of the invention that have been previously described. As most of the parts are of similar type in this embodiment of the invention as in the case of the previous two practical examples, for the sake of simplicity they have been given the same reference numerals with the addition of a prime sign so that an additional detailed explanation is unnecessary.

The essential difference between the construction as depicted in FIG. 4 and the previous examples is to be found in the intake ring 8′ being set back to the extent of measure d, with respect to the plane 30 defined by the inner circumferential surface of the kiln shell lining 6′. An annular collar 31 is attached to the portion 8*a*′ of the intake ring 8′ section that projects into the kiln shell lining 6′ and comprises refractory lining material. The inner edge of the collar overlies the inner edge of the intake ring 8′ by the measure d previously mentioned, thereby also ensuring that the inner area of the terminal flange 15′ is covered by the refractory lining material of the peripheral collar 31 in the manner made apparent by FIG. 4. As the frontal or inner area of the circumferential collar 31 is again flush with the inner circumferential area of the kiln shell lining 6′, there are no troublesome ridges formed in the lining.

In all other respects the peripheral collar 31 has exactly the same configuration and is attached to the exterior of the intake ring is just the same way as has been described in connection with the previous embodiments of the invention.

The additional overlying cover provided for the terminal flange 15′ by part of the lining material of the peripheral collar 31 gives the intake ring 8′ better protection against thermal corrosion and mechanical wear and tear so that the service life of the intake ring 8′ and hence the operational readiness of the rotary kiln according to this invention are increased.

We claim:

1. In a rotary kiln having a refractory lining, a plurality of discharge port openings, a corresponding plurality of planetary cooling tubes, and a corresponding plurality of intake sleeves connected one to each of said tubes and having a portion thereof extending into one of said openings, the improvement comprising annular collars of refractory material separate from said lining and corresponding in number to the number of said sleeves, each of said collars encircling and being snugly fitted to the extending portion of one of said sleeves and being accommodated in an annular recess formed in said lining, each of said collars being flush with the surface of said lining; and hold-down members affixing each of said collars to said extending portion of its associated sleeve.

2. A construction according to claim 1 wherein each of said collars is composed of a plurality of arcuate segments together forming an annulus.

3. A construction according to claim 2 including a separator between confronting ends of each of said segments.

4. A construction according to claim 1 including a separator between said lining and each of said collars.

5. A construction according to claim 4 wherein said separator comprises a layer of lubricant.

6. A construction according to claim 4 wherein said separator comprises a material having a slippery surface.

7. A construction according to claim 1 wherein each of said intake sleeves has an annular wall and inwardly extending flanges at opposite ends of said wall.

8. A construction according to claim 7 including a layer of refractory material lining said wall between said flanges.

9. A construction according to claim 8 wherein said layer bulges inwardly.

10. A construction according to claim 1 wherein that end of each of said intake sleeves which extends into said kiln is flush with the surface of said lining.

11. A construction according to claim 1 wherein that end of each of said intake sleeves which extends into said opening terminates short of the surface of said lining, and wherein said collar has a peripheral flange overlying said end of said sleeve, said flange being of such thickness that said collar is flush with the surface of said lining.

12. A construction according to claim 1 wherein said hold-down members are of various lengths.

13. A construction according to claim 1 wherein an annular gap encircles each of said sleeves, and including thermally insulative material occupying said gap.

14. A construction according to claim 13 wherein said insulative material comprises a wound cord.

15. A construction according to claim 14 wherein said cord is formed of ceramic material.

* * * * *